US008160459B2

(12) United States Patent
Shimizu

(10) Patent No.: US 8,160,459 B2
(45) Date of Patent: Apr. 17, 2012

(54) IMAGE FORMING APPARATUS, TRAY ID MANAGEMENT METHOD, AND COMPUTER-READABLE RECORDING MEDIUM

(75) Inventor: Yuuko Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 645 days.

(21) Appl. No.: 12/318,462

(22) Filed: Dec. 30, 2008

(65) Prior Publication Data

US 2009/0175633 A1 Jul. 9, 2009

(30) Foreign Application Priority Data

Jan. 4, 2008 (JP) ..... 2008-000206
Apr. 10, 2008 (JP) ..... 2008-102335

(51) Int. Cl.
*G03G 15/00* (2006.01)

(52) U.S. Cl. ..... 399/12; 399/13
(58) Field of Classification Search ..... 399/12, 399/13
See application file for complete search history.

(56) References Cited

FOREIGN PATENT DOCUMENTS

JP 2007293246 A * 11/2007
JP 4149137 7/2008

OTHER PUBLICATIONS

English language abstract of Japanese Publication No. JP 2002-281111, published Sep. 27, 2002.

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

An image forming apparatus includes an accumulating unit to accumulate a correspondence of tray classification information that represents a classification of sheet trays and tray identifiers including information for identifying the sheet trays, a determining unit to determine whether there are overlapping tray identifiers in the accumulating unit, the overlapping tray identifiers being tray identifiers that are common for same-tray classification information or different-tray classification information and a changing unit to, when the determining unit determines that there are overlapping tray identifiers, change the overlapping tray identifiers in the accumulating unit so that there are no overlapping tray identifiers.

7 Claims, 16 Drawing Sheets

FIG. 4

| FEED TRAY | TRAY ID | | |
|---|---|---|---|
| TRAY 1 | 10 | 20 | 30 |
| TRAY 2 | 11 | 21 | |
| TRAY 3 | 12 | | |
| TRAY 4 | | | |

FIG. 5

| TRAY ID | MODEL A |
|---|---|
| 1 | TRAY 1 |
| 2 | TRAY 2 |
| 3 | TRAY 3 |
| 4 | TRAY 4 |

FIG. 6

| FEED TRAY | MODEL DEFAULT VALUE | USER SPECIFIED TRAY ID+MODEL DEFAULT TRAY ID | | |
|---|---|---|---|---|
| TRAY 1 | 1 | 10 | 20 | 30 |
| TRAY 2 | 2 | 11 | 21 | |
| TRAY 3 | 3 | 12 | | |
| TRAY 4 | 4 | 4 | | |

IF USER DOES NOT SPECIFY TRAY ID, MODEL DEFAULT VALUE IS USED.

FIG. 10

| TRAY PRIORITY LEVEL | TRAY |
|---|---|
| 1 | PRIORITY FEED TRAY |
| 2 | TRAY 1 (LONG EDGE FEED) |
| 3 | TRAY 2 (LONG EDGE FEED) |
| 4 | TRAY 3 (LONG EDGE FEED) |
| 5 | TRAY 4 (LONG EDGE FEED) |
| 6 | TRAY 1 (SHORT EDGE FEED) |
| 7 | TRAY 2 (SHORT EDGE FEED) |
| 8 | TRAY 3 (SHORT EDGE FEED) |
| 9 | TRAY 4 (SHORT EDGE FEED) |

FIG. 11A

| | TRAY ID (TRAY) | PAPER SIZE/ PAPER TYPE |
|---|---|---|
| | 5 (TRAY 1) | A4/PLAIN |
| | 6 (TRAY 2) | A4/PLAIN |
| ID OVERLAP | 5 (TRAY 3) | A4/PLAIN |
| ID OVERLAP | 6 (TRAY 4) | LETTER/PLAIN |

FIG. 11B

| | TRAY ID (TRAY) | PAPER SIZE/ PAPER TYPE |
|---|---|---|
| | 5 (TRAY 1) | A4/PLAIN |
| | 6 (TRAY 2) | A4/PLAIN |
| NEW NUMBER ASSIGNED | 100 (TRAY 3) | A4/PLAIN |
| NEW NUMBER ASSIGNED | 101 (TRAY 4) | LETTER/PLAIN |

FIG. 12A

| | INDEX | TRAY ID |
|---|---|---|
| | 1 | 5 (TRAY 1) |
| | 2 | 6 (TRAY 2) |
| ID OVERLAP | 3 | 5 (TRAY 3) |
| ID OVERLAP | 4 | 6 (TRAY 4) |

FIG. 12B

| | INDEX | TRAY ID |
|---|---|---|
| | 1 | 5 (TRAY 1) |
| | 2 | 6 (TRAY 2) |
| NEW NUMBER ASSIGNED | 3 | 100 (TRAY 3) |
| NEW NUMBER ASSIGNED | 4 | 101 (TRAY 4) |

FIG. 15A

| | TRAY ID (TRAY) | PAPER SIZE/ PAPER TYPE |
|---|---|---|
| | 5 (TRAY 1) | A4/PLAIN |
| | 6 (TRAY 2) | A4/PLAIN |
| ID OVERLAP | 5 (TRAY 3) | A4/PLAIN |
| ID OVERLAP | 6 (TRAY 4) | LETTER/PLAIN |

FIG. 15B

| | TRAY ID (TRAY) | PAPER SIZE/ PAPER TYPE |
|---|---|---|
| | 5 (TRAY 1) | A4/PLAIN |
| | 6 (TRAY 2) | A4/PLAIN |
| NEW NUMBER ASSIGNED | 1 (TRAY 3) | A4/PLAIN |
| NEW NUMBER ASSIGNED | 2 (TRAY 4) | LETTER/PLAIN |

FIG. 16A

| | INDEX | TRAY ID |
|---|---|---|
| | 1 | 5 (TRAY 1) |
| | 2 | 6 (TRAY 2) |
| ID OVERLAP | 3 | 5 (TRAY 3) |
| ID OVERLAP | 4 | 6 (TRAY 4) |

FIG. 16B

| | INDEX | TRAY ID |
|---|---|---|
| | 1 | 5 (TRAY 1) |
| | 2 | 6 (TRAY 2) |
| NEW NUMBER ASSIGNED | 3 | 1 (TRAY 3) |
| NEW NUMBER ASSIGNED | 4 | 2 (TRAY 4) |

FIG. 19A

| | TRAY ID (TRAY) | PAPER SIZE/ PAPER TYPE |
|---|---|---|
| | 5 (TRAY 1) | A4/PLAIN |
| | 6 (TRAY 2) | A4/PLAIN |
| ID OVERLAP | 5 (TRAY 3) | A4/PLAIN |
| ID OVERLAP | 6 (TRAY 4) | LETTER/PLAIN |

FIG. 19B

| | TRAY ID (TRAY) | PAPER SIZE/ PAPER TYPE |
|---|---|---|
| | 5 (TRAY 1) | A4/PLAIN |
| MODEL DEFAULT VALUE ASSIGNED | 6 (TRAY 2) | A4/PLAIN |
| MODEL DEFAULT VALUE ASSIGNED | 3 (TRAY 3) | A4/PLAIN |
| | 4 (TRAY 4) | LETTER/PLAIN |

FIG. 20A

| | INDEX | TRAY ID |
|---|---|---|
| | 1 | 5 (TRAY 1) |
| | 2 | 6 (TRAY 2) |
| ID OVERLAP | 3 | 5 (TRAY 3) |
| ID OVERLAP | 4 | 6 (TRAY 4) |

FIG. 20B

| | INDEX | TRAY ID |
|---|---|---|
| | 1 | 5 (TRAY 1) |
| MODEL DEFAULT VALUE ASSIGNED | 2 | 6 (TRAY 2) |
| MODEL DEFAULT VALUE ASSIGNED | 3 | 3 (TRAY 3) |
| | 4 | 4 (TRAY 4) |

| FEED TRAY | TRAY ID | | |
|---|---|---|---|
| TRAY 1 | | | |
| TRAY 2 | | | |
| TRAY 3 | 5 | | |
| TRAY 4 | 6 | | |

| FEED TRAY | MODEL DEFAULT VALUE | USER SPECIFIED TRAY ID+MODEL DEFAULT TRAY ID | | |
|---|---|---|---|---|
| TRAY 1 | 1 | 1 | | |
| TRAY 2 | 2 | 2 | | |
| TRAY 3 | 3 | 5 | | |
| TRAY 4 | 4 | 6 | | |

FIG. 24

| FEED TRAY | TRAY ID | | |
|---|---|---|---|
| TRAY 1 | 5 | | |
| TRAY 2 | 6 | | |

FIG. 25

| FEED TRAY | TRAY ID | | |
|---|---|---|---|
| TRAY 1 | 5 | | |
| TRAY 2 | 6 | | |
| TRAY 3 | 5 | | |
| TRAY 4 | 6 | | |

FIG. 26

| FEED TRAY | MODEL DEFAULT VALUE | USER SPECIFIED TRAY ID+MODEL DEFAULT TRAY ID | | |
|---|---|---|---|---|
| TRAY 1 | 1 | 5 | | |
| TRAY 2 | 2 | 6 | | |
| TRAY 3 | 3 | 5 | | |
| TRAY 4 | 4 | 6 | | |

IMAGE FORMING APPARATUS, TRAY ID MANAGEMENT METHOD, AND COMPUTER-READABLE RECORDING MEDIUM

CROSS-REFERENCE TO RELATED APPLICATIONS

The present application claims priority to and incorporates by reference the entire contents of Japanese priority document 2008-000206 filed in Japan on Jan. 4, 2008 and the entire contents of Japanese priority document 2008-102335 filed in Japan on Apr. 10, 2008.

BACKGROUND OF THE INVENTION

1. Field of the Invention

The present invention relates to an image forming apparatus, a tray ID management method used therein, and a computer-readable recording medium.

2. Description of the Related Art

A tray identification data (ID) is used to identify a feed tray, and different image forming apparatus manufactures use, for example, different tray IDs.

Therefore, an image forming apparatus has been available that has a function to specify a plurality of tray IDs to a feed tray, so that the same feed tray can be identified by using different tray IDs. With such a function, when a tray ID is assigned to each feed tray, exclusive control is performed so that the same tray ID cannot be assigned to different feed trays.

Japanese Patent Application Laid-open No. 2002-281111 discloses a technology regarding a protocol analyzer that can analyze a unique protocol and an extended protocol specification by registering the unique protocol specification and the extended protocol specification.

In the above conventional image forming apparatus, for example, if an optional tray is inserted thereto as a feed tray, a tray ID is assigned to the optional tray according to an instruction from a user. Then, if the optional tray is removed from the image forming apparatus, the tray ID assigned to the removed optional tray can be assigned also to another feed tray. Thus, if the optional tray is again inserted thereto, the same tray ID may be assigned to a plurality of different feed trays, as a result. Therefore, among the feed trays having the same tray ID, the feed trays having lower priorities may become unusable.

Thus, applying the technology described in Japanese Patent Application Laid-open No. 2002-281111 can be considered to solve the problem. The technology, however, is model-dependent, and thus, cannot be applied to the above image forming apparatus.

SUMMARY OF THE INVENTION

It is an object of the present invention to at least partially solve the problems in the conventional technology.

According to an aspect of the present invention, there is provided an image forming apparatus that includes a plurality of sheet trays; an accumulating unit that accumulates therein a correspondence of tray classification information that represents a classification of each of the sheet trays and tray identifiers that are information for identifying each of the sheet trays; a determining unit that determines whether there are overlapping tray identifiers in the accumulating unit, the overlapping tray identifiers being tray identifiers that are common for same tray classification information or different tray classification information; and a changing unit that, when the determining unit determines that there are overlapping tray identifiers, changes the overlapping tray identifiers in the accumulating unit so that there are no overlapping tray identifiers.

According to another aspect of the present invention, there is provided a tray ID management method that includes accumulating in a storage unit a correspondence of tray classification information that represents a classification of each of a plurality of sheet trays and tray identifiers that are information for identifying each of the sheet trays; determining whether there are overlapping tray identifiers in the storage unit, the overlapping tray identifiers being tray identifiers that are common for same tray classification information or different tray classification information; and changing, when it is determined at the determining that there are overlapping tray identifiers, the overlapping tray identifiers in the storage unit so that there are no overlapping tray identifiers.

According to still another aspect of the present invention, there is provided a computer-readable recording medium that stores therein computer-readable program codes which when executed cause a computer that controls an image forming apparatus to execute the above tray ID management method.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a schematic diagram of an example of tray ID management information in an apparatus information management application and a tray ID parameter storage area shown in FIG. 3;

FIG. 5 is a schematic diagram of an example of model default tray ID management information stored in a tray ID processing unit shown in FIG. 3;

FIG. 6 is a schematic diagram of an example of a tray ID management table indicating the result of merging the tray ID management information shown in FIG. 4 and the model default tray ID shown in FIG. 5 so that tray IDs are sort in ascending order;

FIG. 10 is a schematic diagram of an example of information regarding tray priority of mountable feed trays, in a priority determining table in the tray ID processing unit;

FIGS. 11A and 11B are schematic diagrams depicting an example of reflecting changes made to a tray management table in a tray information storage area shown in FIG. 3, compared with a conventional example;

FIGS. 12A and 12B are schematic diagrams depicting an example of reflecting changes made to a tray management table in a tray priority storage area shown in FIG. 3, compared with a conventional example;

FIGS. 15A and 15B are schematic diagrams depicting an example of reflecting changes made to the tray management table in the tray information storage area shown in FIG. 3, compared with a conventional example;

FIGS. 16A and 16B are schematic diagrams depicting an example of reflecting changes made to the tray management table in the tray priority storage area shown in FIG. 3, compared with a conventional example;

FIGS. 19A and 19B are schematic diagrams depicting an example of reflecting changes made to the tray management table in the tray information storage area shown in FIG. 3, compared with a conventional example;

FIGS. 20A and 20B are schematic diagrams depicting an example of reflecting changes made to the tray management table in the tray priority storage area shown in FIG. 3, compared with a conventional example;

FIG. 24 is a schematic diagram of an example of tray ID management information in the apparatus information management application with trays removed in the conventional image forming apparatus shown in FIG. 22;

FIG. 25 is a schematic diagram of an example of tray ID management information in the tray ID parameter storage area with the trays removed in the conventional image forming apparatus shown in FIG. 22; and FIG. 26 is a schematic diagram of an example of tray ID management information in the tray management table in the tray ID processing unit with the trays removed in the conventional image forming apparatus shown in FIG. 22.

DETAILED DESCRIPTION OF THE PREFERRED EMBODIMENTS

Exemplary embodiments of the present invention are described in detail below with reference to the accompanying drawings.

Figure 1:
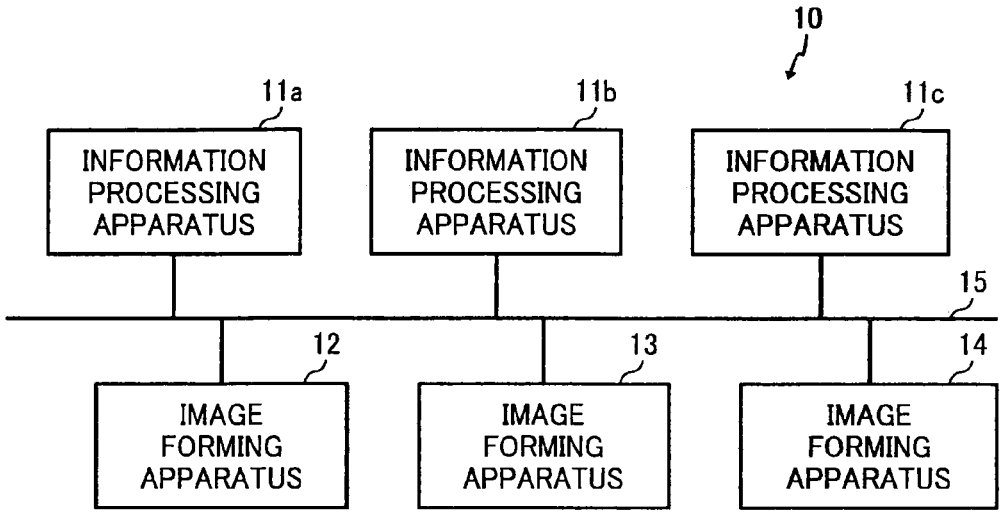
FIG. 1 is a schematic diagram of an overall configuration of an image forming system that employs image forming apparatuses according to an embodiment of the present invention.

FIG. 1 is a schematic diagram of an overall configuration of an image forming system 10 that employs image forming apparatuses according to an embodiment of the present invention.

The image forming system 10 includes information processing apparatuses 11*a* to 11*c* such as a personal computer (PC) and a server and image forming apparatuses 12 to 14 such as a printer and a copier.

The information processing apparatuses 11*a* to 11*c* and the image forming apparatuses 12 to 14 are connected to one another via a communication network 15 such as a local area network (LAN) so that data can be transmitted and received thereamong. By way of example, the image forming apparatuses 12 to 14 have a printing function. Alternatively, other functions such as functions of a copier, a facsimile apparatus (FAX), and a scanner can also be provided.

The information processing apparatuses 11*a* to 11*c* each generate a printer control command (a command described in a printer description language) created by a driver, and selectively transmit the printer control command to the image forming apparatuses 12 to 14 connected via the communication network 15. Printer emulation that interprets all printer control commands is installed in the image forming apparatuses 12 to 14.

Each of the image forming apparatuses 12 to 14 includes a plurality of different feed trays and discharge trays, receives a printer control command transmitted by the information processing apparatuses 11*a* to 11*c*, performs an image forming process (printing process) for forming an image on a recording medium such as paper fed by a selected feed tray, and discharges to a selected discharge tray the recording medium after the image forming process.

The image forming system 10 is not limited to the configuration shown in FIG. 1. For example, the number of the information processing apparatuses can be one, and the number of the image forming apparatuses is not limited to a particular number.

Hardware configuration of each of the image forming apparatuses 12 to 14 shown in FIG. 1 is described with reference to FIG. 2.

Figure 2:
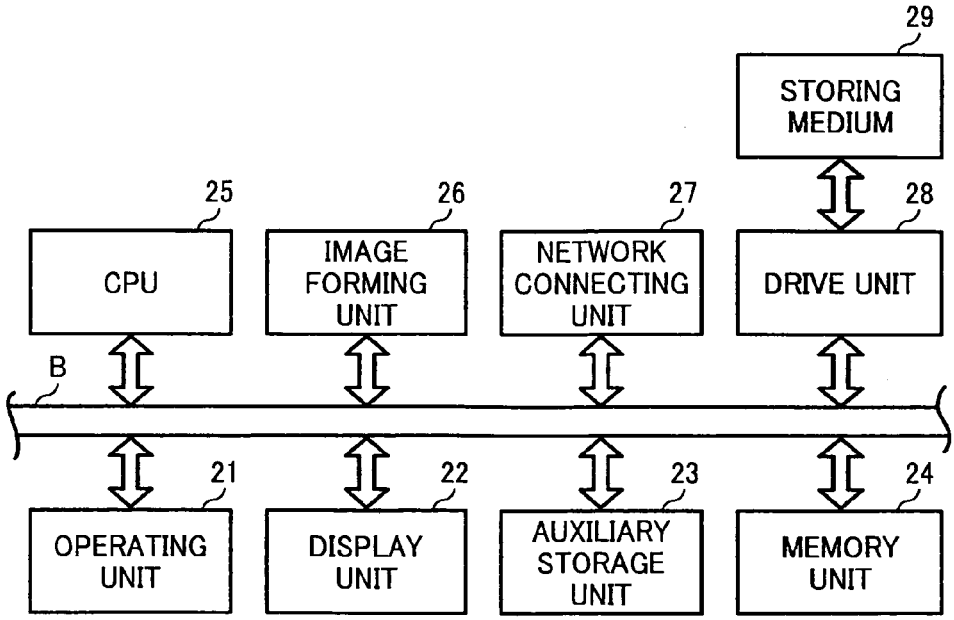
FIG. 2 is a block diagram of a hardware configuration of any arbitrary image forming apparatuses shown in FIG. 1.

FIG. 2 is a block diagram of a hardware configuration of each of the image forming apparatuses 12 to 14.

The image forming apparatuses 12 to 14 each include an operating unit 21, a display unit 22, an auxiliary storage unit 23, a memory 24, a control process unit (CPU) 25 that performs various controls, an image forming unit 26, a network connecting unit 27, and a drive unit 28, all connected to one another via a system bus B.

A user can input various pieces of information (data) by the operating unit 21 to form an image on a recording medium. The operating unit 21 includes a touch panel and a key input unit for inputting certain information.

The CPU 25 executes a control program, and the display unit 22 accordingly displays information such as the changes made, by operating the operating unit 21, to a tray ID parameter described later, the contents of data input by the operating unit 21, and a status during printing. A monitor or the like is used as the display unit 22. The touch panel as described above can be used to serve as both the operating unit 21 and the display unit 22.

The auxiliary storage unit 23 is a storage unit such as a hard disk. The auxiliary storage unit 23 accumulates an executive program (described later) related to the present invention, a control program that controls various components of the image forming apparatuses 12 to 14, the contents of various tables described later, and the like. The auxiliary storage unit 23 can perform input and output as needed.

The memory 24 stores therein an executive program and the like read by the CPU 25 from the auxiliary storage unit 23. The memory 24 includes a read only memory (ROM) and a random access memory (RAM).

The CPU 25 can control the entire processes performed by the computer and perform various processes of, for example, image formation. More specifically, the CPU 25 performs various computational processes and inputs and outputs data from and to various hardware components, according to a control program and an executive program read and stored by the memory 24. The CPU 25 performs an image forming process according to an executive program stored in the memory 24.

As described above, the image forming unit 26 includes a plurality of different feed trays and discharge trays. The image forming unit 26 feeds a recording medium from a selected feed tray, forms an image on the recording medium, and discharges to a selected discharge tray the recording medium on which the image is formed. The operations performed by the image forming unit 26 are controlled by the CPU 25, according to an instruction that is provided by operating the operating unit 21 and an instruction that is input via the network connecting unit 27 from other terminals (either from the information processing apparatuses 11*a* to 11*c* or from the other image forming apparatuses and the like). At least one of the feed trays and the discharge trays is a removable tray removably inserted to the image forming unit 26. Therefore, a sensor that detects insertion and removal of the removable tray is provided in the image forming unit 26.

The network connecting unit 27 obtains various data from the other terminals connected to the communication network 15, by establishing a connection to the communication network 15.

The network connecting unit 27 downloads an executive program related to the present invention from other terminals and the like, and installs the executive program in the auxiliary storage unit 23 and the like, under the control of the CPU 25. In this way, the executive program can be made available, and an obtained execution result or an executive program related to the present invention can be provided to other terminals and the like.

An executive program can be obtained not only from the communication network 15, but also from a storing medium 29 such as a compact disk read only memory (CD-ROM), a flexible disk, a magneto-optical disk (MO), a compact disc recordable (CD-R), a compact disk-rewritable (CD-RW), a digital versatile disk recordable (DVD+R), a digital versatile disk rewritable (DVD+RW), a DVD-R, a DVD-RW, a DVD-RAM, an electrically erasable and programmable read only memory (EEPROM), or a memory card. The storing medium 29 in which an executive program is stored can be set (inserted) to the drive unit 28. The executive program is installed in the auxiliary storage unit 23 via the drive unit 28.

The drive unit 28 can store an executive program related to the present invention in the storing medium 29, under the control of the CPU 25. Thus, the executive program can be easily installed in a plurality of other terminals by using the storing medium 29. As a result, the processes related to the present invention can be performed.

Tray IDs are not specifically defined in a printer description language. Thus, the tray IDs supported by each of the image forming apparatuses 12 to 14 differ according to a manufacturer or a model.

Therefore, if each of the image forming apparatuses 12 to 14 receives different tray IDs from each of the information processing apparatuses 11*a* to 11*c* and the information processing apparatuses 11*a* to 11*c* intend, for example, that a sheet is fed from a normal feed tray, the operation may be completely different from the intention because the tray IDs cannot be recognized. To solve the problem, a function is proposed that facilitates assigning a plurality of different tray IDs to a feed tray by a user operating the WEB (hereinafter, "the user") that is any of the information processing apparatuses 11*a* to 11*c*.

If a tray ID specified by the user (input tray ID) and a model default tray ID (a tray ID that is used when a tray ID is not specified by the user) that is a default (initial) tray ID held by the model overlap each other, the function performs a process that gives higher priority to the tray ID specified by the user, and assigns a new tray ID to the feed tray to which the model default tray ID is assigned. If the tray IDs specified by the user overlap with respect to a plurality of pieces of tray classification information, the function also performs a process that changes the tray IDs corresponding to the pieces of the tray classification information so that any of the tray IDs are not the same.

If a function that assigns a plurality of different tray IDs to a discharge tray is provided, processes similar to those described above can also be performed by using the function. For the convenience of description, the processes performed by such a function are omitted.

The image forming apparatuses 12 to 14 can use feed trays such as a normal feed tray, a manual feed tray, and a high-capacity feed tray. The tray classification information is information that shows a classification of such a feed tray (information unique to each feed tray). Usable feed trays (hereinafter, "tray") include a removable tray as described above. In the present embodiment, the removable tray is an optional tray.

A configuration example of the functions in the information processing apparatuses 11*a* to 11*c* and the image forming apparatuses 12 to 14 shown in FIG. 1 (the functions required for the user to specify on the WEB a tray ID to an image forming apparatus that the user desires to use) is described with reference to FIG. 3.

Figure 3:
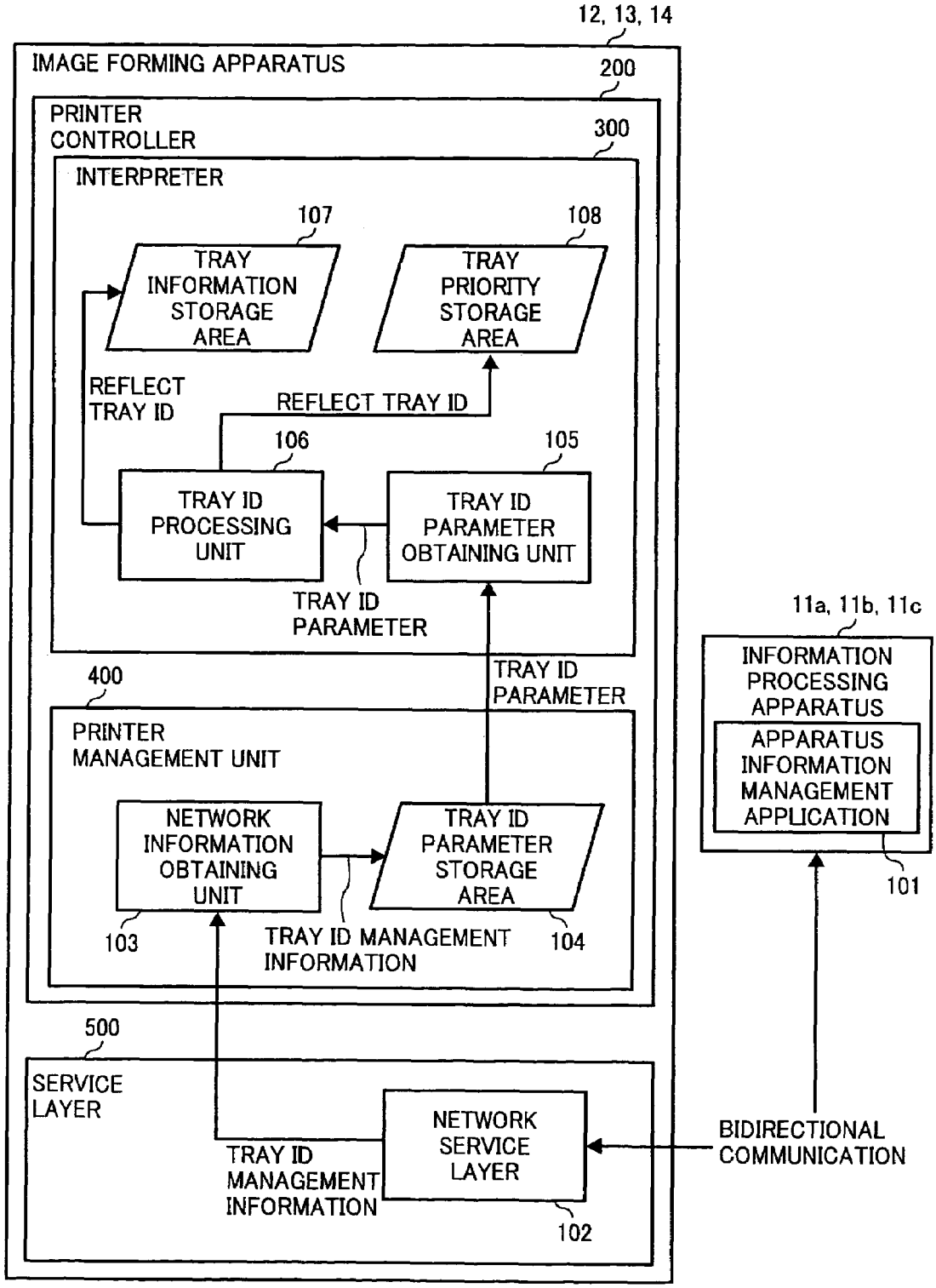
FIG. 3 is a block diagram of the functions in information processing apparatuses and the image forming apparatuses shown in FIG. 1.

FIG. 3 is a block diagram of the functions in the information processing apparatuses 11*a* to 11*c* and the image forming apparatuses 12 to 14.

The image forming apparatuses 12 to 14 each include a printer controller 200 and a service layer 500. The functions performed by the printer controller 200 and the service layer 500 include functions that are performed by an overlap determining unit, a tray ID changing unit, a detecting unit, a process execution instructing unit, an external input unit, and an information notifying unit. The CPU 25 executes the executive program described above, thereby controlling the apparatus to perform the above functions.

The printer controller 200 includes an interpreter 300 and a printer management unit 400.

The interpreter 300 includes a tray ID parameter obtaining unit 105, a tray ID processing unit 106, a tray information storage area 107, and a tray priority storage area 108. The printer management unit 400 includes a network information obtaining unit 103 and a tray ID parameter storage area 104.

The tray information storage area 107, the tray priority storage area 108, and the tray ID parameter storage area 104 are present on the auxiliary storage unit 23. Furthermore, a tray ID management table (tray information accumulating unit) and a priority determining table (priority-level-determining-information accumulating unit) in the tray ID processing unit 106 are also present on the auxiliary storage unit 23. The tray ID management table and the priority determining table are described later.

The service layer 500 includes a network service layer 102.

The information processing apparatuses 11*a* to 11*c* each include an apparatus information management application 101. The computer program (software) is stored in a memory (not shown) and executed by a CPU (not shown). Thus, information regarding each of the information processing apparatuses 11*a* to 11*c* can be managed.

For convenience of description, it is assumed that the computer program itself performs the processes.

The apparatus information management application 101 can bidirectionally communicate with the network service layer 102 included in each of the image forming apparatuses 12 to 14. The apparatus information management application 101 notifies the network service layer 102 included in any of the image forming apparatuses 12 to 14 of tray ID management information. The tray ID management information includes a tray ID parameter (hereinafter, also referred to as "tray ID") that includes the tray IDs specified by the user, for example, by operating an input unit (not shown), for the respective feed trays. In other words, in the tray ID management information, a tray ID of a feed tray is associated with tray classification information that corresponds to the feed tray.

The network service layer 102 included in each of the image forming apparatuses 12 to 14 receives the tray ID management information.

The network information obtaining unit 103 included in each of the image forming apparatuses 12 to 14 receives the tray ID management information from the network service layer 102, and stores the tray ID management information in the tray ID parameter storage area 104.

The tray ID parameter obtaining unit 105 obtains a tray ID from the tray ID parameter storage area 104.

The tray ID processing unit 106 controls the tray ID parameter obtaining unit 105 to obtain a tray ID. The tray ID processing unit 106 assigns the obtained tray ID to the corresponding tray, i.e., to the corresponding tray classification information, and stores the tray ID in the tray ID management table.

At this time, the tray ID processing unit 106 determines whether the tray ID overlaps the model default tray ID (initial tray ID) that is pre-specified to the tray that corresponds to the tray ID. If the tray ID overlaps the model default tray ID, the tray ID processing unit 106 assigns a new tray ID to the tray that corresponds to the model default tray ID, and reflects the changes in the tray information storage area 107 and the tray priority storage area 108.

The tray ID processing unit 106 determines whether tray IDs stored (accumulated) in the tray ID management table overlap with respect to a plurality of pieces of tray classification information. If accumulated tray IDs overlap, the tray ID processing unit 106 changes the tray IDs that correspond to the tray classification information accumulated in the tray ID management table so that any of the tray IDs are not the same. The tray ID processing unit 106 also reflects the changes in the tray information storage area 107 and the tray priority storage area 108.

The tray information storage area 107 stores information regarding the feed trays mounted on the image forming apparatus.

The tray priority storage area 108 stores information regarding tray priority (hereinafter, also referred to as "tray priority level") in the image forming apparatus.

The user can obtain information stored in the storage areas via bidirectional communication by operating an input unit provided in any of the information processing apparatuses 11*a* to 11*c*.

Tray ID management information is described with reference to FIGS. 4 to 6.

FIG. 4 is a schematic diagram of an example of tray ID management information in the apparatus information management application 101 and the tray ID parameter storage area 104.

In the tray ID management information, tray classification information that shows a classification of each feed tray (trays 1 to 4) and a tray ID are associated with each other. The tray classification information of each of the trays 1 and 2 is associated with a plurality of tray IDs specified by each user. The tray classification information of the tray 3 is associated with the tray ID specified by a user. The tray classification information of the tray 4 is not associated with any tray ID.

The apparatus information management application 101 transmits the tray ID management information (information including tray IDs specified by a user) to the network service layer 102.

The network service layer 102 receives the tray ID management information therefrom.

The tray ID parameter obtaining unit 105 obtains a tray ID from the tray ID management information that is transmitted by the network service layer 102 and is stored in the tray ID parameter storage area 104 by the network information obtaining unit 103.

FIG. 5 is a schematic diagram of an example of model default tray ID (initial tray ID) management information stored in the tray ID processing unit 106.

When the user does not specify a tray ID, the model default tray ID is used. The model default tray ID is predefined and is stored in the tray ID processing unit 106 so that the model default tray ID is associated with each of the tray classification information.

The tray ID processing unit 106 merges the tray ID management information including tray IDs shown in FIG. 4 and obtained by the tray ID parameter obtaining unit 105 and the model default tray ID management information shown in FIG. 5 so that tray IDs are sort in ascending order.

FIG. 6 is a schematic diagram of an example of the tray ID management table indicating the result of the merge.

In the present embodiment, only "4" that is the model default tray ID of the tray 4 is associated with the tray classification information of the tray 4, because the user does not specify a tray ID.

Embodiments having different features in the image forming apparatuses 12 to 14 according to the present invention are described in greater detail with reference to FIGS. 7 to 20. It is assumed that each of the image forming apparatuses 12 to 14 includes normal feed trays 1 to 7, a manual feed tray, and a high-capacity feed tray as usable feed trays.

Before describing the embodiments having different features according to the present invention, a problem that occurs in a conventional technology is described for facilitating comprehension with reference to FIGS. 21 to 26 and also with FIG. 3 for convenience of description.

In the present invention, such a situation is considered to be a problem that the same tray ID is assigned to different feed trays by insertion and removal of an optional tray. The problem is described in greater detail.

Figures 21, 22, 23:
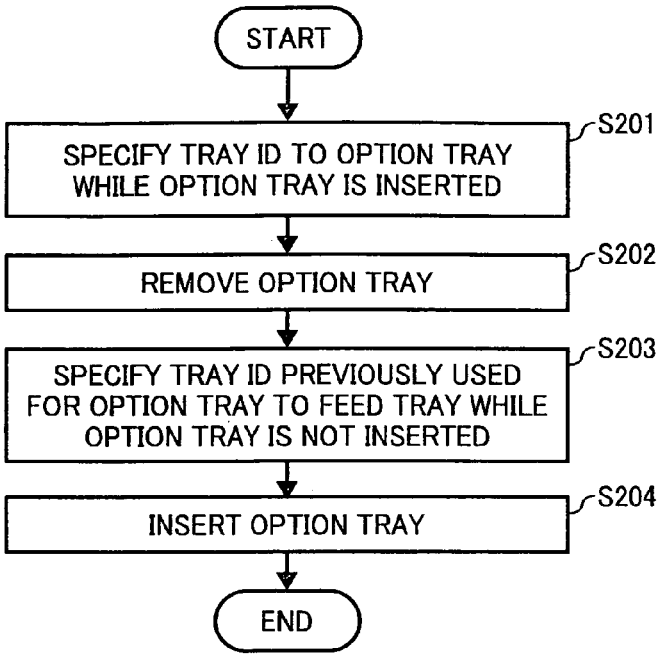
FIG. 21 is a flowchart of procedures of processes performed by a tray ID processing unit and operations performed by a user until overlapping of tray IDs occurs in a conventional image forming apparatus.
FIG. 22 is a schematic diagram of an example of tray ID management information in an apparatus information management application and a tray ID parameter storage area in the conventional image forming apparatus.
FIG. 23 is a schematic diagram of an example of tray ID management information in a tray management table in the tray ID processing unit in the conventional image forming apparatus shown in FIG. 22.

FIG. 21 is a flowchart of procedures of processes performed by the tray ID processing unit 106 and operations performed by a user until overlapping of tray IDs occurs in a conventional image forming apparatus (hereinafter, simply "apparatus").

The tray ID processing unit 106 included in the apparatus specifies a tray ID to an optional tray by the user's operation while the optional tray is inserted to the apparatus (Step S201).

The user removes the optional tray from the apparatus (Step S202).

The tray ID processing unit 106 specifies the tray ID used at Step S201 to another feed tray by the user's operation while the optional tray is not inserted to the apparatus (Step S203).

The user puts the optional tray removed at Step S202 into the previous status. That is, the user inserts the optional tray into the image forming apparatus (Step S204).

How the tray ID is managed and used in the apparatus in the operations shown in FIG. 21 is described below in greater detail.

In an apparatus in which the trays 3 and 4 among the feed trays are optional trays, the user specifies the tray IDs "5" and "6" respectively to the trays 3 and 4. Then, the tray IDs are registered in the tray ID management information stored in the apparatus information management application 101 and in the tray ID parameter storage area 104, as shown in FIG. 22.

The tray ID processing unit 106 controls the tray ID parameter obtaining unit 105 to obtain a tray ID parameter from the tray ID management information stored in the tray ID parameter storage area 104, and registers the tray ID parameter in the tray ID management information in the tray ID management table as shown in FIG. 23. If a tray ID is not specified by a user as in the trays 1 and 2, the model default tray ID shown in FIG. 5 is used.

While the trays 3 and 4 are removed, the user assigns to the trays 1 and 2 the same tray IDs "5" and "6" that are assigned previously to the trays 3 and 4 respectively. The tray IDs are registered in the tray ID management information stored in the apparatus information management application 101 and in the tray ID parameter storage area 104 as shown in FIGS. 24 and 25.

The tray IDs "5" and "61" that are the tray IDs before the removal of the trays 3 and 4 are accumulated in the tray ID parameter storage area 104.

The tray ID processing unit 106 controls the tray ID parameter obtaining unit 105 to obtain a tray ID from the tray ID management information stored in the tray ID parameter storage area 104, and registers the tray ID in the tray ID management information in the tray ID management table as shown in FIG. 26.

Thus, the same tray ID "5" is assigned to the trays 1 and 3, and the same tray ID "6" is assigned to the trays 2 and 4. Therefore, if the user inserts the trays 3 and 4 back in the apparatus, the same tray IDs "5" and "66" are assigned to different feed trays. Embodiments to solve the problem are described below.

A first embodiment of the present invention is described below in greater detail with reference to FIGS. 7 to 12.

If tray IDs specified by the user overlap each other due to insertion and removal of an optional tray, the image forming apparatuses 12 to 14 assign a new tray ID that is a value of "100" or more to each of the feed trays having lower priority among the feed trays to which the overlapping tray IDs are assigned. Then, any value from "0" to "99" can be used as a model default tray ID and a tray ID specified by the user (existing tray ID). The value that can be assigned as a new tray ID is not limited to "100" or more. For example, the value of "200" or more can be assigned as a new tray ID.

Figure 7:
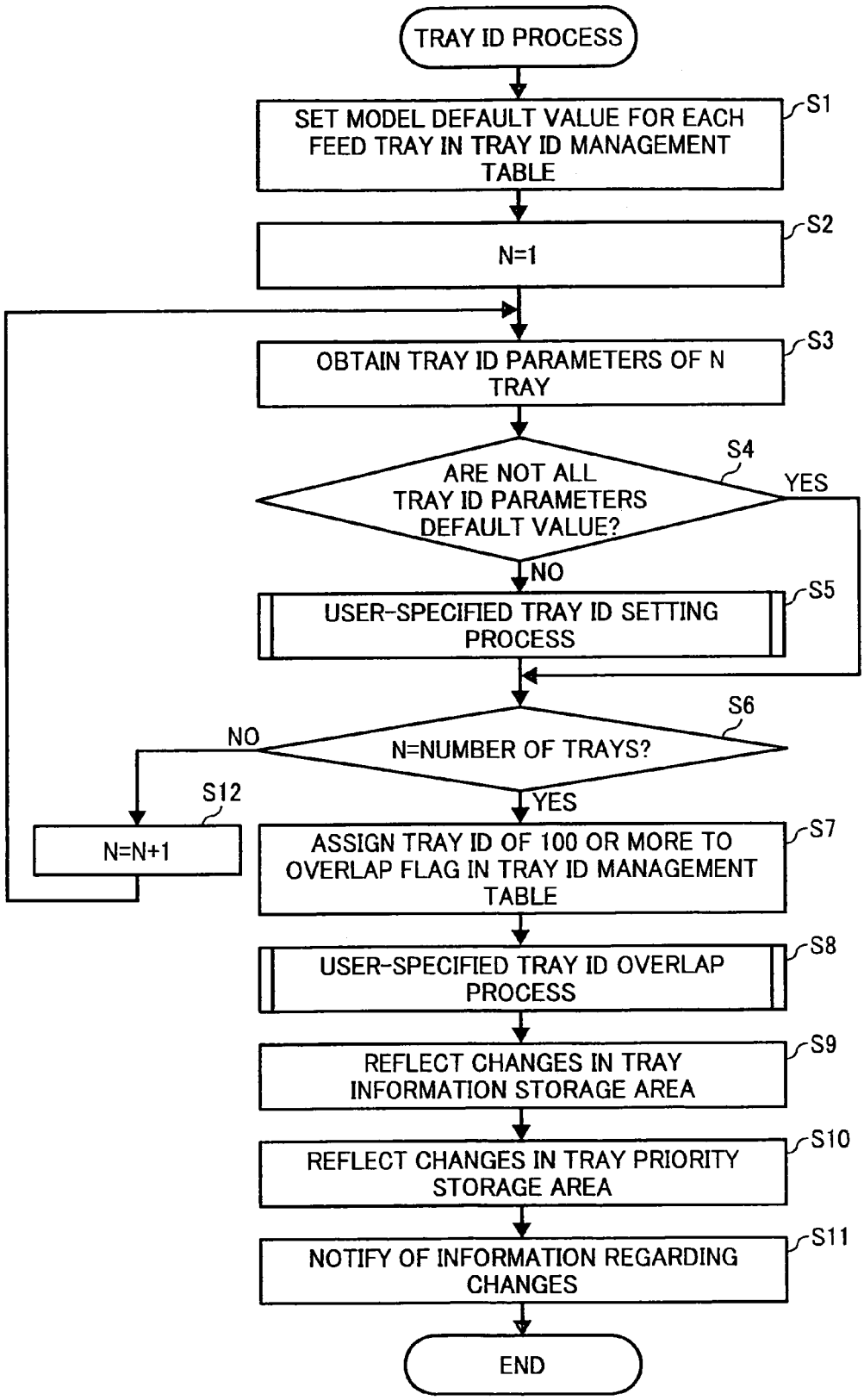
FIG. 7 is a flowchart of an example of a tray ID process performed by the tray ID processing unit shown in FIG. 3 according to a first embodiment of the present invention.

FIG. 7 is a flowchart of an example of a tray ID process performed by the tray ID processing unit 106 included in each of the image forming apparatuses 12 to 14, that is, a process for generating a tray ID management table by merging the model default tray ID management information and the tray ID management information that includes tray IDs specified by the user, according to the first embodiment.

The tray ID processing unit 106 periodically starts the processes shown in FIG. 7 according to a call from a main routine (not shown). First, the tray ID processing unit 106 sets in the tray ID management table the model default tray ID (model default value) for each feed tray accumulated in the predefined model default tray ID management information (Step S1). Then, the tray ID processing unit 106 sets a counter value N of a tray specifying counter (not shown) to "1" (Step S2).

The tray specifying counter is used to specify a feed tray corresponding to the tray ID parameter to be processed. Therefore, if the feed trays mounted on (inserted to) each of the image forming apparatuses 12 to 14 are the normal feed trays 1 to 7, the manual feed tray, and the high-capacity feed tray, then when a count value N of the tray specifying counter is "1", the normal feed tray 1 is a feed tray corresponding to the tray ID parameter to be processed (hereinafter, "N tray"). When the count value N is "2", the normal feed tray 2 is the N tray. When the count value N is "3", the normal feed tray 3 is the N tray. When the counter value N is "4", the normal feed tray 4 is the N tray. When the count value N is "5", the normal feed tray 5 is the N tray. When the count value N is "6", the normal feed tray 6 is the N tray. When the count value N is "7", the normal feed tray 7 is the N tray. When the count value N is "8", the manual feed tray is the N tray. When the count value N is "9", the high-capacity feed tray is the N tray.

The tray ID processing unit 106 controls the tray ID parameter obtaining unit 105 to obtain the tray ID parameters corresponding to the N tray (first, the normal feed tray 1) from the tray ID parameters constituting the tray ID management information stored in the tray ID parameter storage area 104, and temporarily stores the tray ID parameters in a temporary storage area (not shown) (Step S3). The tray ID parameters correspond to a tray ID specified by the user or a default value (empty information) that is a parameter other than the tray ID specified by the user. If a user does not specify a tray ID, the tray ID parameters are not overwritten therewith, and the tray ID parameter remains the default value. As a result, the tray ID parameter obtaining unit 105 obtains the default value.

The tray ID processing unit 106 determines whether each of the tray ID parameters corresponding to the N tray stored in the temporary storage area is the default value (Step S4). If all the tray ID parameters are the default values (YES at Step S4), the system control goes to Step S6. If at least one of the tray ID parameters is not the default value (NO at Step S4), the tray ID parameters include a tray ID specified by the user. Therefore, the tray ID processing unit 106 performs a user-specified tray ID setting process that is described later (Step S5), and the system control goes to Step S6.

The tray ID processing unit 106 determines whether the count value N of the tray specifying counter reaches the number of trays (in the present embodiment, the number of trays is "9") (Step S6). The system control goes to Step S12 or Step S7 according to the result of the determination. Before describing the processes performed at Steps S12 and S7, the user-specified tray ID setting process performed at Step S5 is described with reference to FIG. 8.

Figure 8:
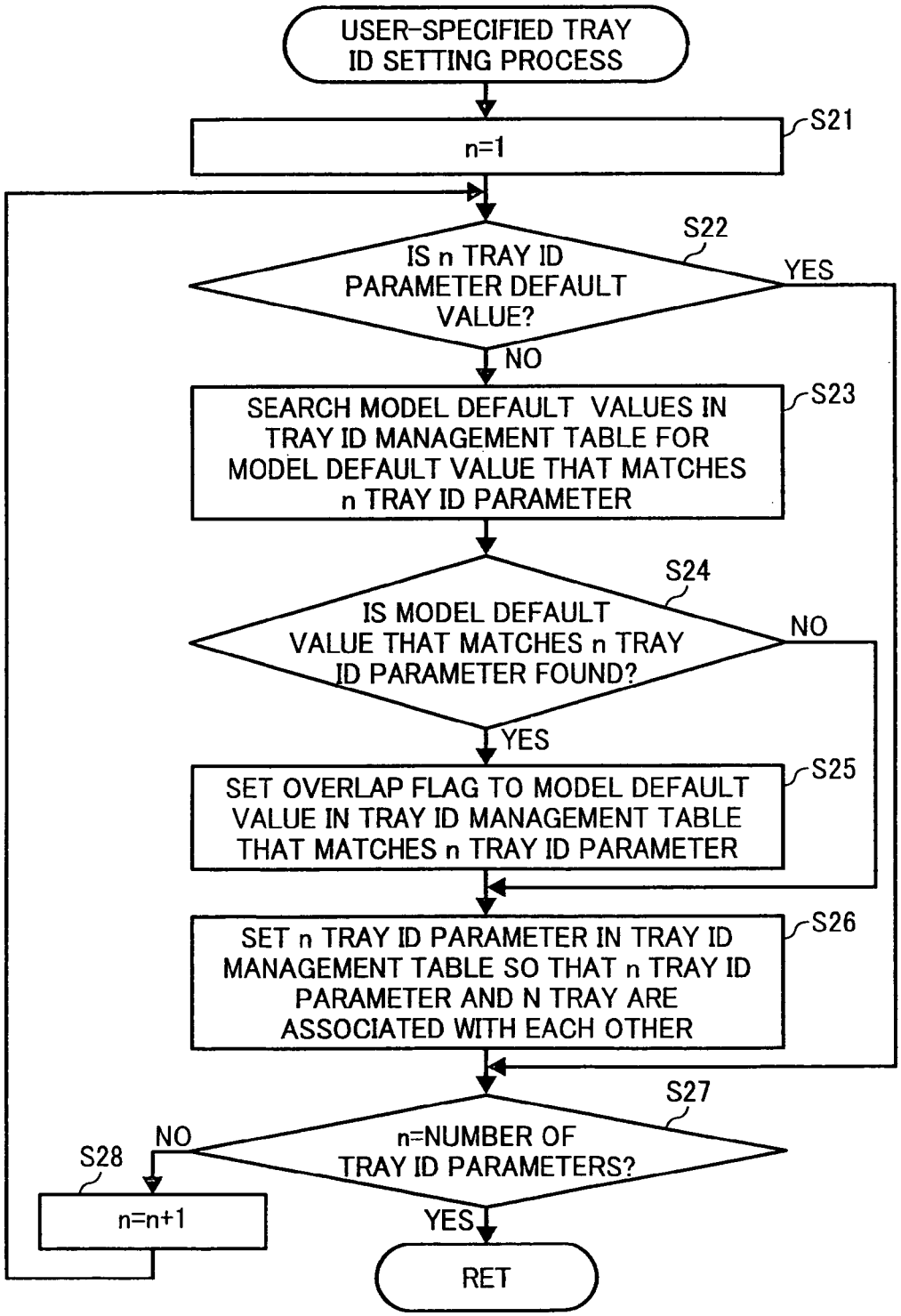
FIG. 8 is a flowchart of an example of a user-specified tray ID setting process that is a subroutine of the tray ID process shown in FIG. 7.

FIG. 8 is a flowchart of an example of the user-specified tray ID setting process that is a subroutine of the tray ID process shown in FIG. 7.

The tray ID processing unit 106 sets the count value n of a tray ID parameter specifying counter (not shown) to "1" (Step S21).

The tray ID parameter specifying counter is used to specify a tray ID parameter to be processed. For example, if the tray ID parameters corresponding to the tray classification information of the N tray (hereinafter, "N tray") stored in the temporary storage area are "10", "30", and "the default value", then when the count value n is "1", the tray ID corresponding to the N tray is "10", when the count value n is "2", the tray ID corresponding to the N tray is "30", and when the count value n is "3", the tray ID corresponding to the N tray is "the default value".

The tray ID processing unit 106 determines whether the tray ID parameter corresponding to the count value n ("1") of the tray ID parameter specifying counter (hereinafter, "n tray ID parameter") is the default value (Step S22). If the tray ID parameter is the default value (YES at Step S22), the system control goes to Step S27. If the tray ID parameter is not the default value (NO at Step S22), that is, the tray ID parameter is one of the tray IDs specified by the user, the system control goes to Step S23.

The tray ID processing unit 106 searches the model default tray IDs in the tray ID management table for a value matching the n tray ID parameter (Steps S23 and S24).

As a result of the searching, if the tray ID processing unit 106 determines that none of the model default tray IDs in the tray ID management table matches the n tray ID parameter (NO at Step S24), the system control goes to Step S26. If at least one of the model default tray IDs matches the n tray ID parameter (YES at Step S24), the tray ID processing unit 106 sets an overlap flag (a provisional value) to each of the model default tray IDs in the tray ID management table that matches the n tray ID parameter (Step S25), and the system control goes to Step S26.

The tray ID processing unit 106 sets the n tray ID parameter (the n tray ID specified by a user) in the tray ID management table so that the n tray ID parameter is associated with the tray classification information of the N tray (Step S26).

The tray ID processing unit 106 determines whether the count value n of the tray ID parameter specifying counter reaches the number of the tray ID parameters of the N tray (for example, "3") (Step S27). If the count value n does not reach the number of the tray ID parameters (NO at Step S27), the system control goes to Step S28 at which the count value n of the tray ID parameter specifying counter is incremented, that is, "1" is added to the count value n, and returns to Step S22. Then, the processes following Step S22 are performed again.

If the count value n of the tray ID parameter specifying counter reaches the number of the tray ID parameters of the N tray (YES at Step S27), the processes shown in FIG. 8 end, and the system control returns to the processing routine shown in FIG. 7 and goes to Step S6.

Then, the tray ID processing unit 106 determines whether the count value N of the tray specifying counter reaches the number of the trays.

If the count value N of the tray specifying counter does not reach the number of the trays (NO at Step S6), the system control goes to Step S12 at which the count value N of the tray specifying counter is incremented, that is, "1" is added to the count value N, and returns to Step S3. Then, the processes following Step S3 are performed again. The processes are repeated until the count value N of the tray specifying counter reaches "9", that is, the processes are repeated as many times as the number of the trays mounted on the apparatus. More specifically, appropriate processes are sequentially performed for the normal feed trays 2 to 7, the manual feed tray, and the high-capacity feed tray.

If the count value N of the tray specifying counter reaches the number of the trays (YES at Step S6), the system control goes to Step S7 and the tray ID processing unit 106 performs the following processes.

Specifically, if the tray ID specified by the user (input tray ID) matches the model default tray ID (initial tray ID), the tray ID processing unit 106 refers to the overlap flag in the tray ID management table, searches for a tray ID whose value is in a range of "100" or more that is different from the range in which the values of the tray ID specified by the user and the model default tray ID are included, assigns the tray ID to the overlap flag, and overwrites the overlap flag with the tray ID. If there is a plurality of overlap flags, different tray IDs are respectively assigned to the overlap flags.

The tray ID processing unit 106 performs a user-specified tray ID overlap process that is described later (Step S8), and then reflects the changes (the new tray ID(s)) made to the tray ID management table in the tray information storage area 107 (Step S9). The tray ID processing unit 106 reflects the changes made to the tray ID management table also in the tray priority storage area 108 (Step S10), and then transmits information regarding the changes made to the tray ID management table to the information processing apparatuses 11*a* to 11*c* via the network service layer 102 to notify thereof and controls the display unit 22 to display the information (Step S11). The information regarding the changes made to the tray ID management table can be displayed by the display unit 22 shown in FIG. 2, or can also be printed on a recording medium by the image forming unit 26. If an audio output unit such as a speaker is provided, the information regarding the changes can also be output by the audio output unit.

Figure 9:
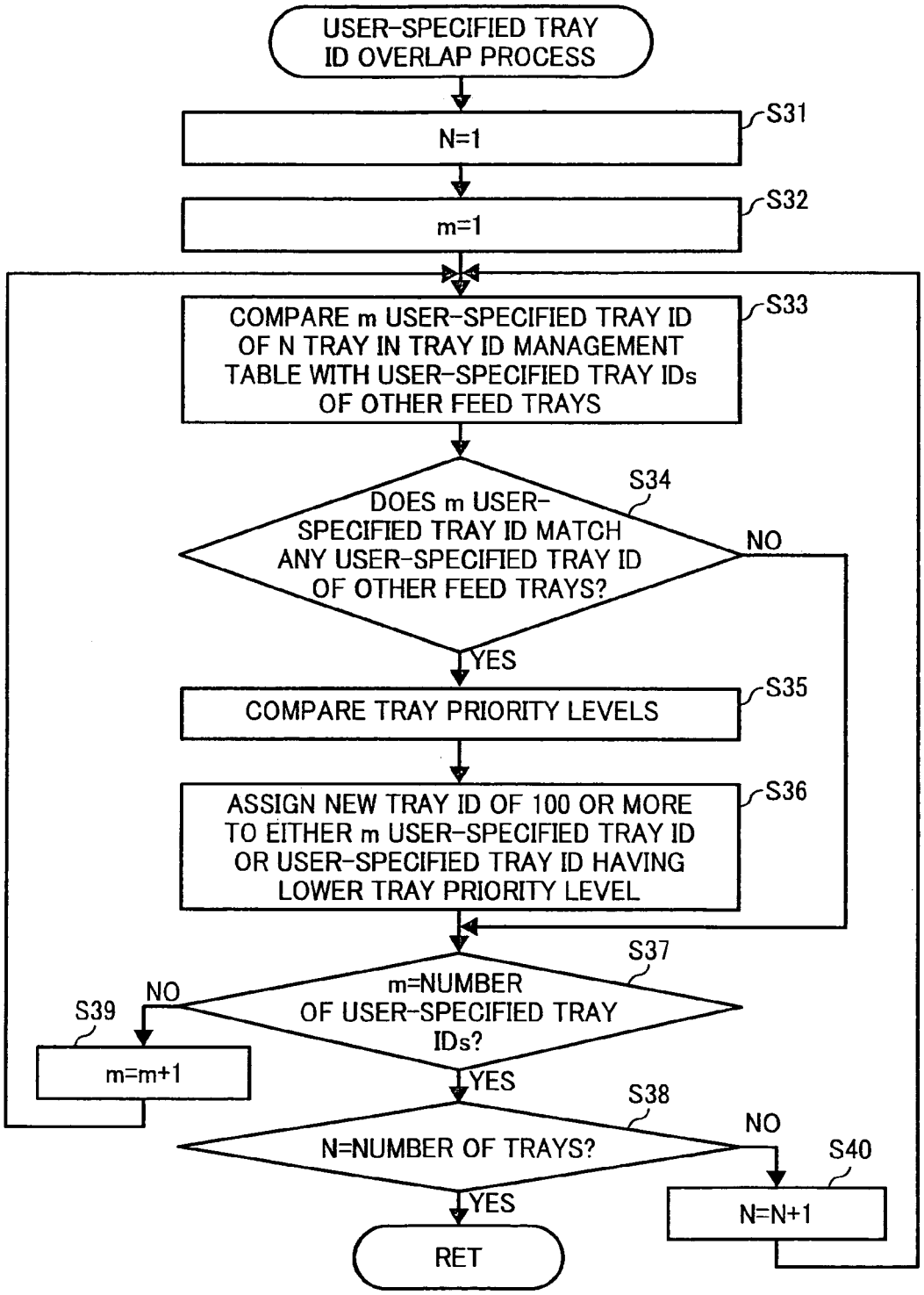
FIG. 9 is a flowchart of an example of a user-specified ID overlap process that is a subroutine of the tray ID process shown in FIG. 7.

FIG. 9 is a flowchart of an example of the user-specified ID overlap process that is a subroutine of the tray ID process shown in FIG. 7.

The tray ID processing unit 106 sets the count value N of the tray specifying counter to "1" again (Step S31), and sets the count value m of a user-specified tray ID specifying counter to "1" (Step S32).

The user-specified tray ID specifying counter is used to specify a tray ID specified by the user (hereinafter, "user-specified tray ID") that is to be processed. For example, if the user-specified tray IDs corresponding to the N tray in the tray ID management table are "10" and "30", then when the count value m is "1", the user-specified tray ID corresponding to the N tray is "10", and when the counter value m is "2", the user-specified tray ID corresponding to the N tray is "30".

The system control goes to Step S33. The tray ID processing unit 106 sequentially compares the tray ID corresponding to the count value m ("1") of the user-specified tray ID specifying counter corresponding to the N tray in the tray ID management table (hereinafter, "m user-specified tray ID") with the tray IDs corresponding to the other feed trays (Step S33), and determines whether the m user-specified tray ID is accumulated to overlap with respect to the tray classification information of the other feed trays (Step S34).

If the m user-specified tray ID does not overlap with respect to the tray classification information of the other feed trays (NO at Step S34), the tray ID processing unit 106 determines that none of the user-specified tray IDs corresponding to the other feed trays matches the m user-specified tray ID corresponding to the N tray. Therefore, the system control goes to Step S37.

If the m user-specified tray ID is accumulated to overlap with respect to the tray classification information of the other feed trays (YES at Step S34), the tray ID processing unit 106 determines that at least one of the user-specified tray IDs corresponding to the other feed trays matches the m user-specified tray ID corresponding to the N tray. Therefore, the system control goes to Step S36.

At Step S36, the tray ID processing unit 106 searches for a tray ID whose value is in a range of "100" or more that is different from the range in which values of the m user-specified tray ID corresponding to the N tray and the user-specified tray ID corresponding to any other feed trays that matches the m user-specified tray ID are included. The tray ID processing unit 106 then assigns the tray ID either to the m user-specified tray ID corresponding to the N tray or to the user-specified tray ID corresponding to the feed tray that matches the m user-specified tray ID, whichever is given a lower tray priority level, according to information regarding the tray priority (tray priority level) of mountable feed trays in a priority determining table, and overwrites the tray ID with the tray ID.

FIG. 10 is a schematic diagram of an example of information regarding tray priority of mountable feed trays. In FIG. 10, for convenience of illustration, the information is omitted regarding tray priority level of the feed trays other than the priority feed tray and the normal feed trays 1 to 4.

Information regarding tray priority of mountable feed trays is defined according to each model of image forming apparatuses. In the information regarding the tray priority, the tray classification information showing the classification of each feed tray is associated with the tray priority thereof. The tray ID processing unit 106 reads the information from an external file (not shown), and stores the information in the priority determining table in the tray ID processing unit 106.

In the example shown in FIG. 10, the feed tray having the tray priority level "1" is the priority feed tray. The priority feed tray is specified by the user from the normal feed trays 1 to 4 having the tray priority levels "1" to "9". The feed trays having the tray priority levels "2" to "5" are the normal feed trays 1 to 4 (Long Edge Feed), and the feed trays having the tray priority level "6" to "9" are the normal feed trays 1 to 4 (Short Edge Feed). "Long Edge Feed" means that the paper orientation is set so that the paper is fed from a longer edge, and "Short Edge Feed" means that the paper orientation is set so that the paper is fed from a shorter edge.

When the process at Step S36 is completed, the system control goes to Step S37. The tray ID processing unit 106 determines whether the count value m of the user-specified tray ID specifying counter reaches the number of the user-specified tray IDs of the N tray (e.g., "2") (Step S37). If the count value m does not reach the number of the user-specified tray IDs (NO at Step S37), the system control goes to Step S39 at which the count value m of the user-specified tray ID specifying counter is incremented, that is, "1" is added to the count value m, and returns to Step S33. Then, the processes following Step S33 are performed again.

If the count value m of the user-specified tray ID specifying counter reaches the number of the user specifying counter of the N tray (YES at Step S37), the tray ID processing unit 106 determines whether the count value N of the tray specifying counter reaches the number of the trays (Step S38). If the count value N does not reach the number of the trays (NO at Step S38), the count value N of the tray specifying counter is incremented, that is, "1" is added thereto (Step S40), and the processes following Step S33 are performed again. If the count value N of the tray specifying counter reaches the number of the trays (YES at Step S40), the processes shown in FIG. 9 end, the system control returns to the processing routines shown in FIG. 7 and goes to Step S9.

The process performed at Step S8 can be removed from the processing routines shown in FIG. 7, and a process similar to the processes performed at Steps S8 to S11 can be performed only when insertion of an optional tray is detected.

FIG. 11B is a schematic diagram of an example result of reflecting changes made to the tray management table in the tray information storage area 107. FIG. 12B is a schematic diagram of an example result of reflecting changes made to the tray management table in the tray priority storage area 108. For convenience of description, in the data stored in the tray information storage area 107 and in the tray priority storage area 108, the data regarding the feed trays other than the normal feed trays 1 to 4 is omitted.

In the present embodiment, the corresponding new tray IDs "100" and "101" are assigned to the normal feed trays (optional trays) 3 and 4, respectively. This is because if the tray ID "5" is assigned by the user to the normal feed tray 1 having the user-specified tray ID "5" and the tray ID "6" is assigned by the user to the normal feed tray 2 having the user-specified tray ID "6", the specified tray IDs and the user-specified tray IDs corresponding to the normal feed trays 3 and 4 overlap each other as shown in FIGS. 11A and 12A.

Thus, according to the first embodiment, the effects can be obtained shown in (A1) to (A7) below.

(A1) A process (overlap determining process) is performed that determines whether user-specified tray IDs, accumulated in the tray management table (tray information accumulating unit) that accumulates tray classification information showing a classification of each of a plurality of feed trays and tray IDs arbitrarily input (user-specified tray ID) to identify the trays so that the tray classification information is associated with the tray IDs, overlap with respect to a plurality of pieces of tray classification information. If it is determined that the user-specified tray IDs accumulated in the tray management table overlap with respect to the tray classification information, a process (tray ID changing process) is performed that changes the user-specified tray IDs corresponding to the tray classification information accumulated in the tray management table so that the user-specified tray IDs are not the same each other. This prevents that a tray becomes unusable because tray IDs assigned to a plurality of different trays overlap each other.

(A2) Reassigned tray IDs that are changed tray IDs are stored in an area in which mounted tray information, obtainable by the user as information from the image forming apparatuses, is stored. Thus, by obtaining on the Web a reassigned tray ID from a desired image forming apparatus, the user can specify the tray corresponding to the reassigned tray ID as a tray to be used, and paper can be fed from the tray.

(A3) Information regarding priority of the trays to be used is stored in the tray priority storage area. Because new tray IDs are assigned to trays whose tray IDs overlap each other, information of the tray whose tray IDs overlap never drops. As a result, operation of the trays whose tray IDs overlap is not contradictory to the information stored in the tray priority storage area (tray priority storage arrangement) that the user can refer to.

(A4) If at least one of a plurality of trays (in the present embodiment, an optional tray) is a removable tray removably inserted to a particular image forming apparatus, the overlap determining process and the tray ID changing process can be performed when insertion of the removable tray is detected. This prevents that a tray becomes unusable because tray IDs assigned to a plurality of trays overlap each other due to insertion and removal of the removable tray.

(A5) A tray priority determining table (priority-level-determining-information accumulating unit) is provided that accumulates the tray classification information and the tray priority (priority level) so that they are associated with each other. If it is determined that the user-specified tray IDs accumulated in the tray management table overlap with respect to a plurality of pieces of tray classification information, the tray IDs corresponding to the pieces of tray classification information accumulated in the tray management table can be changed according to the priority level so that the tray IDs corresponding to the pieces of tray classification information accumulated in the tray management table are not the same (that is, a user-specified tray ID assigned to a tray having a higher priority is used without change, and a different tray ID is reassigned to a tray having a lower priority). This leads to improved operating efficiency of the user's specifying a tray to be used among the trays.

(A6) If it is determined that the user-specified tray IDs accumulated in the tray management table overlap with respect to the pieces of tray classification information, the tray IDs corresponding to the pieces of tray classification information accumulated in the tray management table can be changed to tray IDs whose values are included in a range (e.g., "100" or more) that is different from the range in which the values of the current tray IDs accumulated in the tray management table are included. Thus, a value to be used as a tray ID after the change (reassigned tray ID) can be easily searched for, thereby reducing processing load of the CPU.

(A7) Information regarding the reassigned tray IDs is notified. Therefore, the user can recognize that a tray ID is reassigned.

A second embodiment of the present invention is described below in greater detail with reference to FIGS. 13 to 16.

If tray IDs specified by the user overlap each other due to insertion and removal of an optional tray, each of the image forming apparatuses 12 to 14 assigns an arbitrary tray ID of "0" to "n" as a new tray ID to a feed tray having lower priority to which an overlapping tray ID is assigned.

Figure 13:
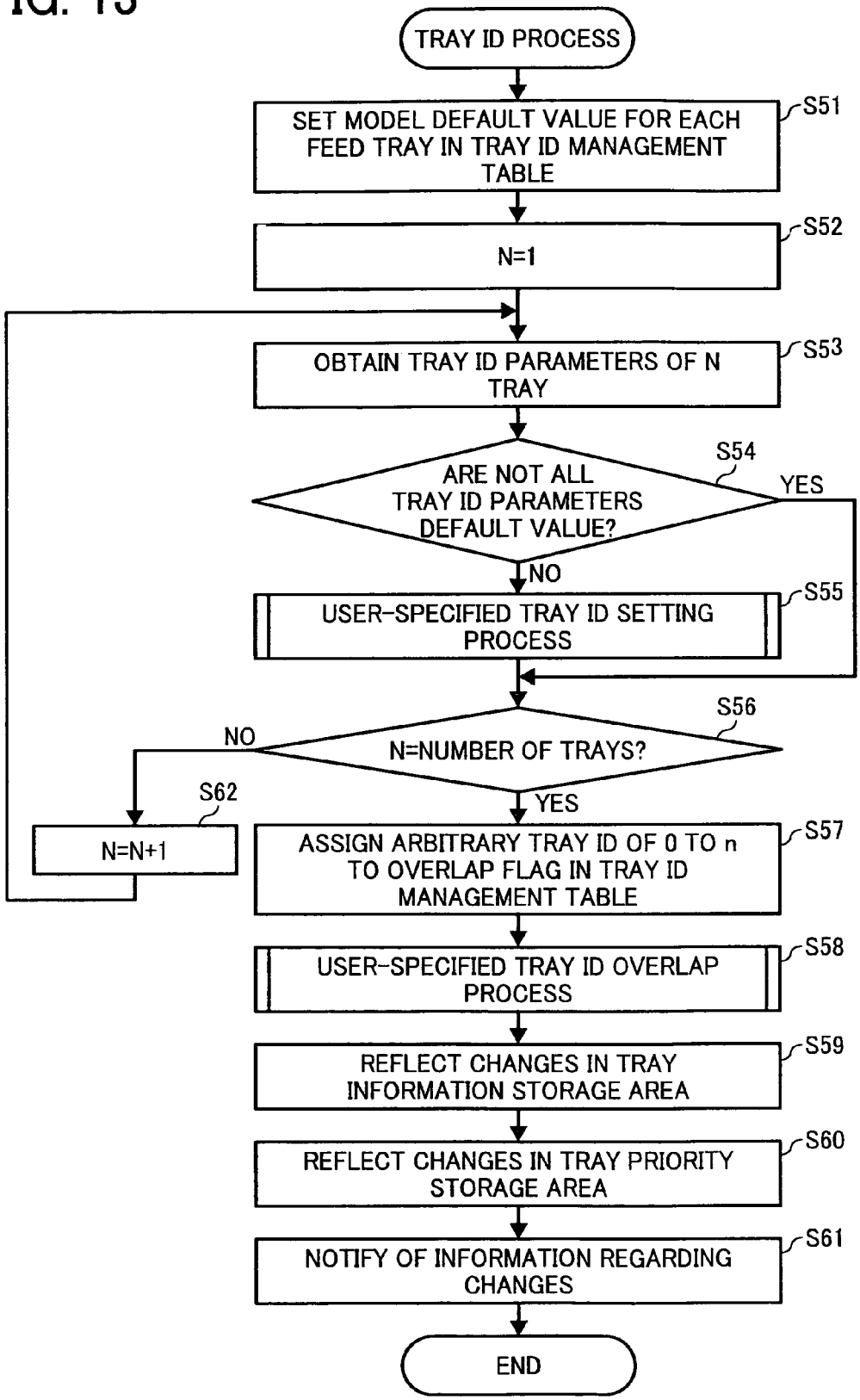
FIG. 13 is a flowchart of an example of a tray ID process performed by the tray ID processing unit shown in FIG. 3 according to a second embodiment of the present invention.

FIG. 13 is a flowchart of an example of a tray ID process performed by the tray ID processing unit 106 included in each of the image forming apparatuses 12 to 14 according to the second embodiment.

The tray ID processing unit 106 included in each of the image forming apparatuses 12 to 14 periodically starts the processes shown in FIG. 13 according to a call from the main routine, and performs processes at Steps S51 to S62. The processes are identical to the processes performed at Steps S1 to S12 described with reference to FIGS. 7 to 9 with the exception of the processes performed at Steps S57 and S58 that correspond to Steps S7 and S8.

At Step S57, if the tray ID specified by the user (input tray ID) matches the model default tray ID (initial tray ID), the tray ID processing unit 106 refers to the overlap flag in the tray ID management table, searches for an arbitrary tray ID of "0" to "n" (not including the tray IDs already used), assigns the tray ID to the overlap flag, and overwrites the overlap flag with the tray ID. If there is a plurality of overlap flags, an arbitrary tray ID is sequentially searched for so that a smaller value is first searched for, and each of the overlap flags is assigned with the arbitrary tray ID.

At Step S58, a user-specified tray ID overlap process (described later) is performed.

Figure 14:
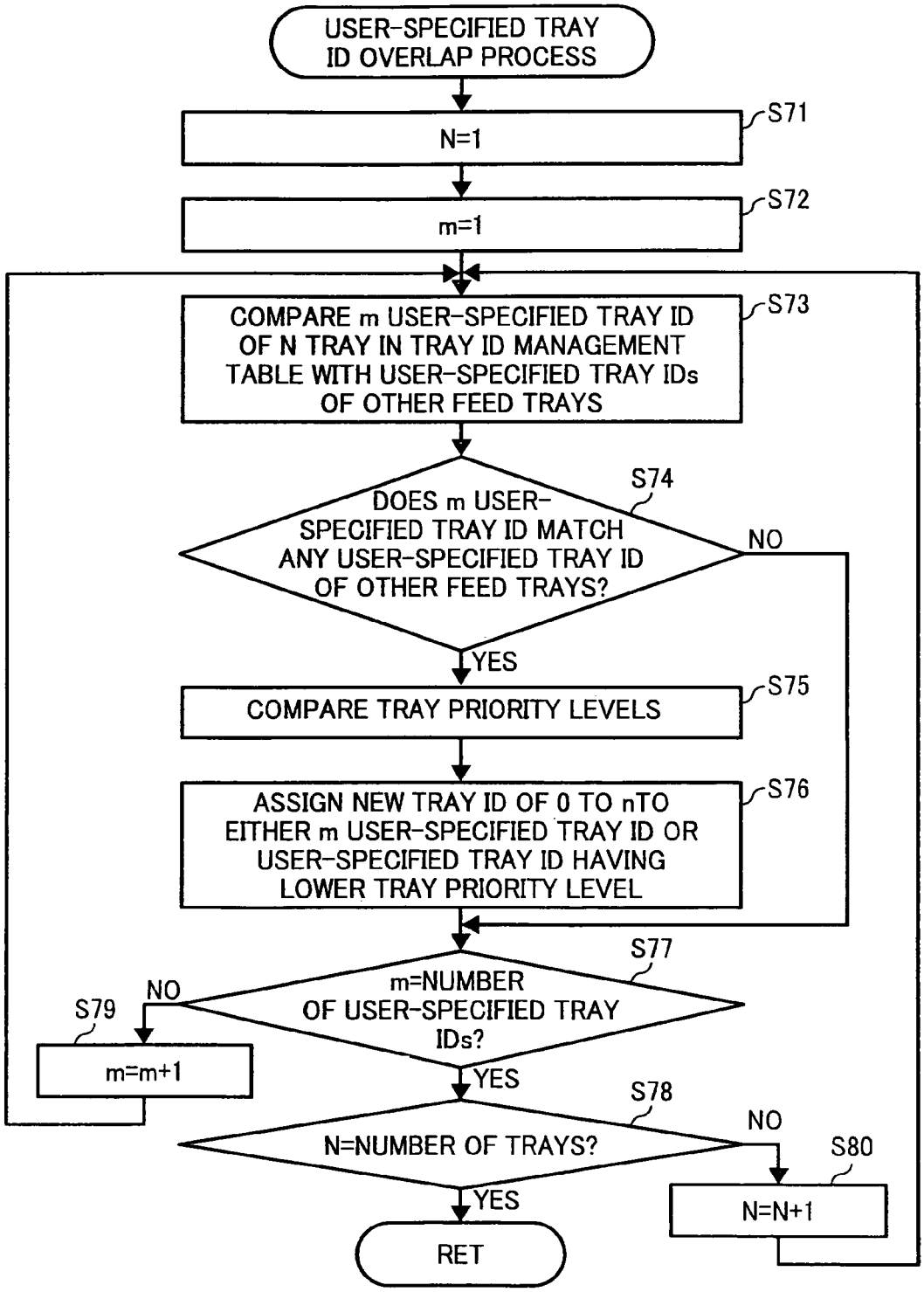
FIG. 14 is a flowchart of an example of a user-specified tray ID overlap process that is a subroutine of the tray ID process shown in FIG. 13.

FIG. 14 is a flowchart of an example of the user-specified tray ID overlap process that is a subroutine of the tray ID process shown in FIG. 13.

The tray ID processing unit 106 performs the processes at Steps S71 to S80. The processes are identical to the processes performed at Steps S31 to S40 shown in FIG. 9 with the exception of the process performed at Step S76 that corresponds to Step S36.

At Step S76, the tray ID processing unit 106 searches for a new tray ID whose value is "0" to "n" (not including the tray IDs already used), assigns the new tray ID either to the m user-specified tray ID corresponding to the N tray or to the user-specified tray ID corresponding to any other feed trays that matches the m user-specified tray ID, whichever is given a lower tray priority level, according to the information regarding tray priority of mountable feed trays in a priority determining table, and overwrites the tray ID with the new tray ID. When a new tray ID is searched for, a smaller value is searched for first.

FIG. 15B is a schematic diagram of an example result of reflecting changes made to the tray management table in the tray information storage area 107. FIG. 16B is a schematic diagram of an example result of reflecting changes made to the tray management table in the tray priority storage area 108. For convenience of description, in the data stored in the tray information storage area 107 and in the tray priority storage area 108, the data regarding the feed tray other than the normal feed trays 1 to 4 is omitted.

In the present embodiment, the corresponding new tray IDs "1" and "2" are assigned to the normal feed trays (optional trays) 3 and 4, respectively. This is because if the tray ID "5" is assigned by the user to the normal feed tray 1 having the user-specified tray ID "5" and the tray ID "6" is assigned by the user to the normal feed tray 2 having the user-specified tray ID "6", the specified tray IDs and the user-specified tray IDs corresponding to the normal feed trays 3 and 4 overlap each other as shown in FIGS. 15A and 16A.

Thus, according to the second embodiment, the effects can be obtained as shown in (A1) to (A5) and (A7) described above.

If it is determined that the user-specified tray IDs accumulated in the tray management table overlap with respect to the pieces of tray classification information, the tray IDs corresponding to the pieces of tray classification information accumulated in the tray management table can be changed to an arbitrary value (including the existing values). This leads to reduced memory consumption, though searching for a value to be used as a tray ID after the change (reassigned tray ID) is more time consuming.

A third embodiment of the present invention is described below in greater detail with reference to FIGS. 17 to 20.

If tray IDs specified by the user overlap each other due to insertion and removal of an optional tray, each of the image forming apparatuses 12 to 14 assigns the original model default tray ID (see FIG. 5) to a feed tray having lower priority to which an overlapping tray ID is assigned.

Figure 17:
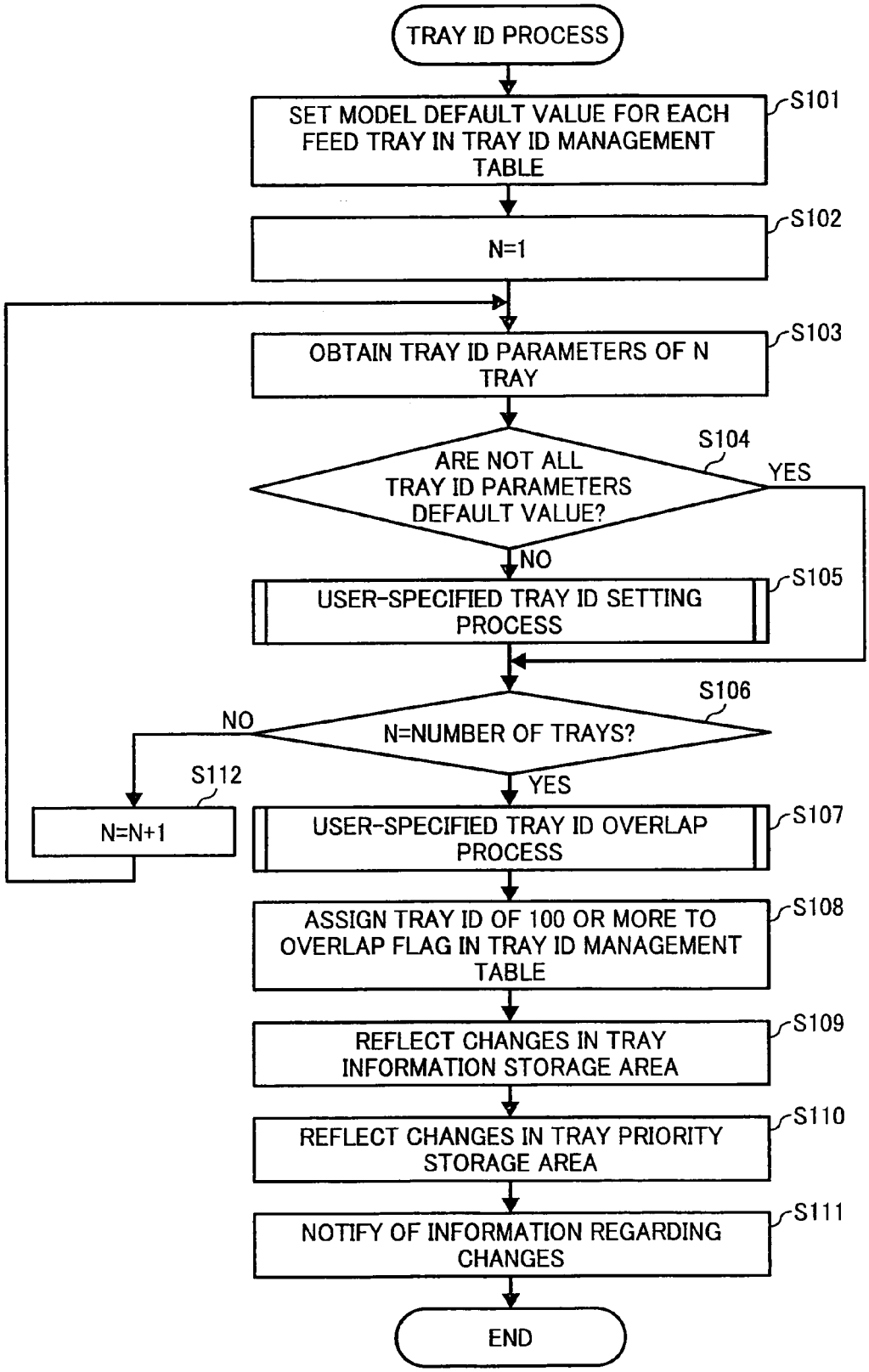
FIG. 17 is a flowchart of an example of a tray ID process performed by the tray ID processing unit shown in FIG. 3 according to a third embodiment of the present invention.

FIG. 17 is a flowchart of an example of a tray ID process performed by the tray ID processing unit 106 included in each of the image forming apparatuses 12 to 14 according to the third embodiment.

The tray ID processing unit 106 included in each of the image forming apparatuses 12 to 14 periodically starts the processes shown in FIG. 17 according to a call from the main routine, and performs processes at Steps S101 to S112. The processes are identical to the processes performed at Steps S1 to S12 described with reference to FIGS. 7 to 9 with the exception of the processes performed at Steps S107 and S108 that correspond to Steps S7 and S8.

At Step S107, a user-specified tray ID overlap process (described below) is performed.

At Step S108, if the tray ID specified by the user (input tray ID) matches the model default tray ID (initial tray ID), the tray ID processing unit 106 refers to the overlap flag in the tray ID management table, searches for a tray ID whose value is included in a range of "100" or more that is different from the range in which the values of the tray ID specified by the user and the model default tray ID are included, assigns the tray ID to the overlap flag, and overwrites the overlap flag with the tray ID. If there is a plurality of overlap flags, a different tray ID is assigned with each of the overlap flags.

Figure 18:
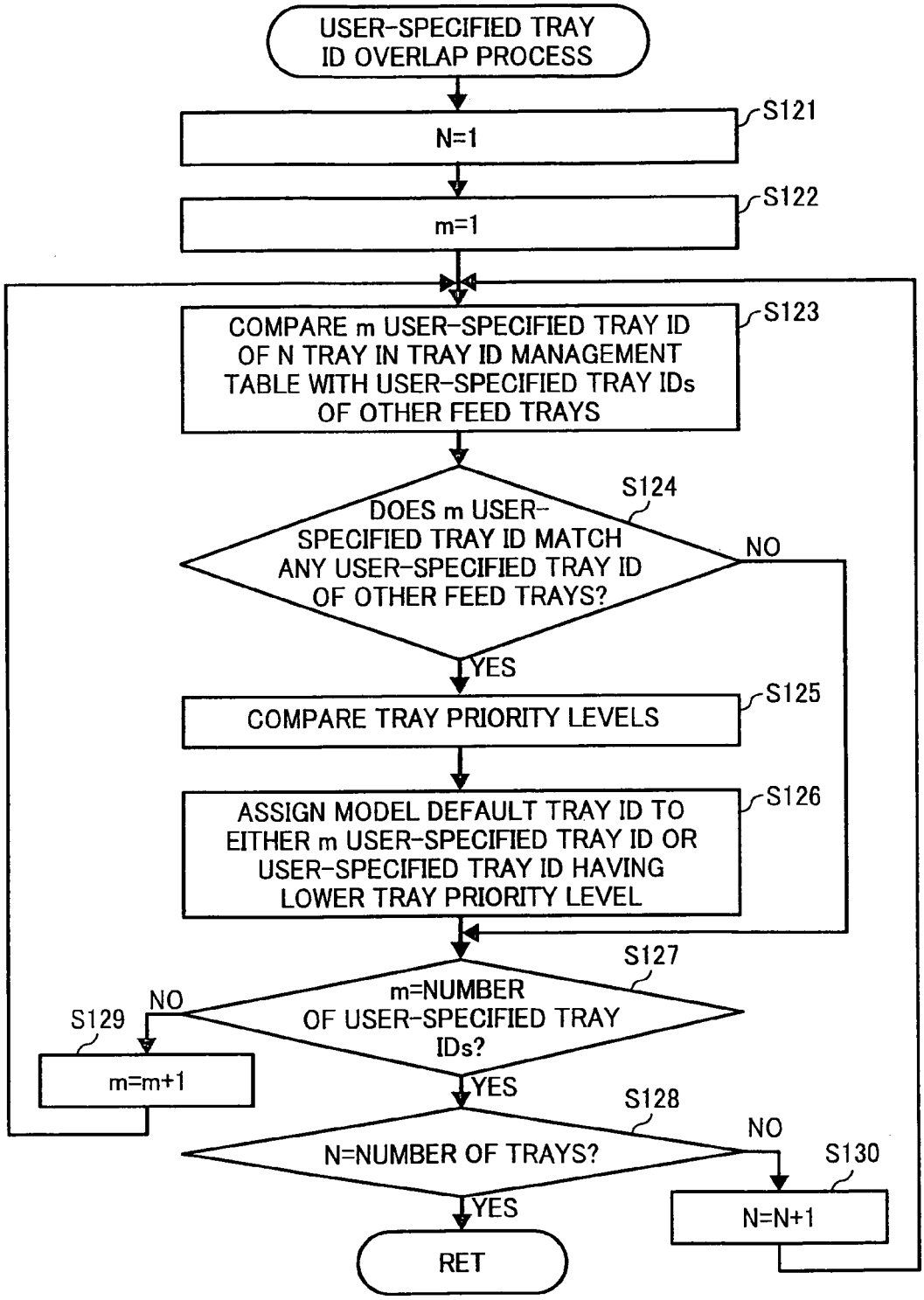
FIG. 18 is a flowchart of an example of a user-specified tray ID overlap process that is a subroutine of the tray ID process shown in FIG. 17.

FIG. 18 is a flowchart of an example of the user-specified tray ID overlap process that is a subroutine of the tray ID process shown in FIG. 17.

The tray ID processing unit 106 performs the processes at Steps S121 to S130. The processes are identical to the processes performed at Steps S31 to S40 shown in FIG. 9 with the exception of the process performed at Step S126 that corresponds to Step S36.

At Step S126, the tray ID processing unit 106 assigns the original model default tray ID, that is different from the m user-specified tray ID corresponding to the N tray and the user-specified tray ID corresponding to any other feed trays that matches the m user-specified tray ID, either to the m user-specified tray ID or to the user-specified tray ID, whichever is given a lower tray priority level, according to information regarding tray priority of mountable feed trays in a priority determining table, and overwrites the tray ID.

FIG. 19B is a schematic diagram of an example result of reflecting changes made to the tray management table in the tray information storage area 107. FIG. 20B is a schematic diagram of an example result of reflecting changes made to the tray management table in the tray priority storage area 108. For convenience of description, in the data stored in the tray information storage area 107 and the tray priority storage area 108, the data regarding the feed tray other than the normal feed trays 1 to 4 is omitted.

In the present embodiment, the original model default tray IDs (model default values) "3" and "4" are assigned to the normal feed trays (optional trays) 3 and 4, respectively. This is because if the tray ID "5" is assigned by the user to the normal feed tray 1 having the user-specified tray ID "5" and the tray ID "6" is assigned by the user to the normal feed tray 2 having the user-specified tray ID "6", the specified tray IDs and the user-specified tray IDs corresponding to the normal feed trays 3 and 4 overlap each other as shown in FIGS. 19A and 20A.

Thus, according to the third embodiment, the effects can be obtained as shown in (A1) to (A5) and (A7) described above.

If it is determined that the user-specified tray IDs accumulated in the tray management table overlap with respect to the pieces of tray classification information, the tray IDs corresponding to the pieces of tray classification information accumulated in the tray management table can be changed to the original model default tray ID. Thus, searching for a value to be used as a tray ID after the change (reassigned tray ID) becomes unnecessary, thereby reducing processing load of the CPU and memory consumption.

According to the first to the third embodiments, the tray IDs corresponding to the normal feed trays 1 to 7, the manual feed tray, and the high-capacity feed tray can be set as tray IDs corresponding to trays that can be used. The types of the IDs that can be set as tray IDs in the present invention is not limited thereto. For example, a tray ID corresponding to various types of discharge trays such as normal discharge trays can also be set. A value of a tray ID is not limited to a numeral. For example, a character or a combination of character and numeral can also be used as a value thereof.

According to an aspect of the present invention, it can be avoided that a tray becomes unusable because tray IDs assigned to a plurality of different trays overlap each other.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of sheet trays;

an accumulating unit to accumulate therein a correspondence of tray classification information that represents a classification of each of the sheet trays and tray identifiers that are information for identifying each of the sheet trays;

a determining unit to determine whether there are overlapping tray identifiers in the accumulating unit, the overlapping tray identifiers being tray identifiers that are common for same tray classification information or different tray classification information; and a changing unit to, when the determining unit determines that there are overlapping tray identifiers, change the overlapping tray identifiers in the accumulating unit so that there are no overlapping tray identifiers, wherein the image forming apparatus further comprises a priority-level accumulating unit to accumulate therein a correspondence of the tray classification information and a priority level of each of the sheet trays, wherein the changing unit is configured to change the overlapping tray identifiers according to the priority level.

2. The image forming apparatus according to claim 1, wherein the tray identifiers are included in a first range, and the changing unit is configured to change the overlapping tray identifiers to new tray identifiers included in a second range that is different from the first range.

3. The image forming apparatus according to claim 1, further comprising an input unit that is used to accumulate the tray identifiers in the accumulating unit.

4. The image forming apparatus according to claim 1, further comprising a notifying unit to notify changed tray identifiers to an image processing apparatus connected to the image forming apparatus.

5. A tray ID management method comprising:

accumulating in a storage unit a correspondence of tray classification information that represents a classification of each of a plurality of sheet trays and tray identifiers that are information for identifying each of the sheet trays;

determining whether there are overlapping tray identifiers in the storage unit, the overlapping tray identifiers being tray identifiers that are common for same tray classification information or different tray classification information; and changing, when it is determined at the determining that there are overlapping tray identifiers, the overlapping tray identifiers in the storage unit so that there are no overlapping tray identifiers, wherein the accumulating includes accumulating in the storage unit a correspondence of the tray classification information and a priority level of each of the sheet trays, and the changing includes changing the overlapping tray identifiers according to the priority level.

6. The tray ID management method according to claim 5, wherein the tray identifiers are included in a first range, and the changing includes changing the overlapping tray identifiers to new tray identifiers included in a second range that is different from the first range.

7. A non-transitory computer-readable recording medium that stores therein computer-readable program codes that when executed cause a computer that controls an image forming apparatus to execute:

accumulating in a storage unit a correspondence of tray classification information that represents a classification of each of a plurality of sheet trays and tray identifiers that are information for identifying each of the sheet trays;

determining whether there are overlapping tray identifiers in the storage unit, the overlapping tray identifiers being tray identifiers that are common for same tray classification information or different tray classification information; and changing, when it is determined at the determining that there are overlapping tray identifiers, the overlapping tray identifiers in the storage unit so that there are no overlapping tray identifiers, wherein the accumulating includes accumulating in the storage unit a correspondence of the tray classification information and a priority level of each of the sheet trays, and the changing includes changing the overlapping tray identifiers according to the priority level.

* * * * *